United States Patent [19]

Doubrava et al.

[11] 4,256,810

[45] Mar. 17, 1981

[54] HIGH CONDUCTIVITY TITANIUM ELECTRODE

[75] Inventors: James H. Doubrava, South Euclid; Edward L. Thellmann, Walton Hills, both of Ohio

[73] Assignee: Gould Inc., Rolling Meadows, Ill.

[21] Appl. No.: 966,092

[22] Filed: Dec. 4, 1978

[51] Int. Cl.[3] ..... B32B 5/20; B22F 3/14; B22F 3/16

[52] U.S. Cl. ..... 428/550; 75/208 R; 428/548

[58] Field of Search ..... 428/550, 548; 75/208 R; 429/235, 237

[56] References Cited

U.S. PATENT DOCUMENTS

| | | | |
|---|---|---|---|
| 2,251,410 | 8/1941 | Koehring et al. | 75/208 R X |
| 2,906,803 | 9/1959 | Brown | 75/208 R |
| 3,311,507 | 3/1967 | Dittmann et al. | 428/550 X |
| 3,321,286 | 5/1967 | Clark et al. | 428/550 |
| 3,394,445 | 7/1968 | Valyi | 428/550 X |

FOREIGN PATENT DOCUMENTS

| | | | |
|---|---|---|---|
| 1517596 | 2/1968 | France | 428/548 |
| 844171 | 8/1960 | United Kingdom | 428/312 |
| 922599 | 4/1963 | United Kingdom | 428/550 |
| 1069403 | 5/1967 | United Kingdom | 428/457 |
| 1197514 | 7/1970 | United Kingdom | 428/550 |
| 1288600 | 9/1972 | United Kingdom | 75/208 R |

*Primary Examiner*—Richard D. Lovering
*Attorney, Agent, or Firm*—Richard D. Minnich; Edward E. Sachs; Russell E. Baumann

[57] ABSTRACT

A highly electrically conductive composite electrode is provided which comprises an inner layer of an electrically conductive metal, a first outer layer of pressed and sintered powdered titanium metallurgically bonded thereto and a second outer layer of porous sintered powdered titanium bonded to the surface of the first outer layer, the first outer layer of powdered titanium being compacted to a degree sufficient to render it essentially impermeable to aqueous brine and the surface of the second outer layer having an apparent density of from about 30 to about 90 percent.

6 Claims, 4 Drawing Figures

HIGH CONDUCTIVITY TITANIUM ELECTRODE

DESCRIPTION OF THE INVENTION

The present invention concerns a composite structure comprising an inner layer of an electrically conductive material, a first outer layer of pressed and sintered powdered titanium, and, optionally, a second outer layer of sintered porous powdered titanium bonded to at least part of the surface of the first outer layer, which composite structure is characterized by having an electrical resistance which is lower than that of chemically pure wrought titanium.

In the chlor-alkali industry it is common practice to use titanium metal as a material of construction for the fabrication of electrodes and various conductors, such as bus bars and the like. This is due to the fact that titanium is a passive metal. However, while titanium possesses this desirable characteristic of passivity, it nevertheless suffers from the inherent defect that it is a relatively poor electrical conductor. Accordingly, when used as an electrode or as a conducting member fairly thick segments of titanium metal must be employed in order to obtain acceptable current density.

Therefore, it is desirable to obtain a material which has the passivity of titanium but which also is highly electrically conductive. In addition, it is desirable to obtain a structure which can be readily coated with mixed metal oxides used to increase the conductivity of a titanium article.

The composite structure of the invention finds exceptional utility in the chlor-alkali industry. A typical structure which is suitable as a bus bar includes a conductive inner core or layer having an outer layer of sintered powdered titanium bonded thereto. A typical electrode structure suitable for use in the production of chlorine and caustic includes, in addition to the conductive inner layer and outer layer of powdered titanium, a second outer layer of porous powdered titanium which is adapted to receive a coating of mixed metal oxides commonly used to increase the conductivity of wrought titanium electrodes.

SUMMARY OF THE INVENTION

In one aspect the present invention concerns an electrically conductive composite structure comprising an inner layer of an electrically conductive material and an outer layer of pressed and sintered powdered titanium, with the composite structure being characterized by having an electrical resistance which is lower than that of chemically pure wrought titanium.

In another aspect, the present invention concerns an electrically conductive composite structure comprising an inner layer of an electrically conductive metal having an outer layer of pressed and sintered powdered titanium metallurgically bonded thereto, with the surface of the powdered titanium being compacted to a degree sufficient to render it essentially impermeable to aqueous brine.

In still another aspect, the present invention concerns an electrically conductive composite structure comprising an inner layer of an electrically conductive metal, a first outer layer of pressed and sintered powdered titanium metallurgically bonded thereto, and a second outer layer of sintered porous powdered titanium bonded to at least a portion of the surface of the first outer layer said first outer layer of powdered titanium being compacted to a degree sufficient to render it essentially impermeable to aqueous brine and said second outer layer of porous sintered titanium having an apparent density of from about 30 to 90 percent.

DESCRIPTION OF THE DRAWINGS

The invention may take physical form in certain parts and arrangement of the parts, the preferred embodiments of which will be described in detail in the specification and illustrated in the accompanying drawings which form a part hereof and wherein.

DESCRIPTION OF THE PREFERRED EMBODIMENTS OF THE INVENTION

Figure 1:
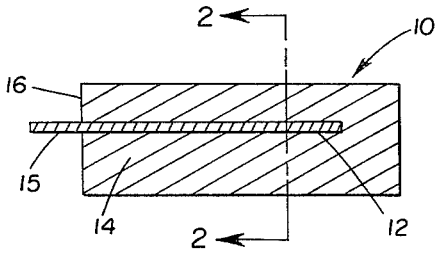
FIG. 1 is a cross-sectional view of a diagrammatical illustration of one form of an electrode constructed in accordance with the subject invention.

Referring now to the drawings wherein the showings are for purposes of illustration and not for purposes of limitation, FIG. 1 shows an electrode 10 comprised of an outer layer 14 of powdered titanium which is metallurgically bonded to an inner layer 12 of conductive metal, such as copper, with a portion 15 of the copper layer extending from surface 16 of the electrode. The embodiment shown in FIG. 1 is for illustrative purposes only and other electrode configurations will be readily apparent to those skilled in the art. In FIG. 1, the protruding portion of the copper layer is present as a means of making suitable electrical contact with a source of electrical current.

For the sake of brevity, the present invention will in the main be described with regard to various electrode configurations. However, it is understood that it may take other forms such as a conductive composite which is used to produce electrical bus bars and the like.

Figure 2:
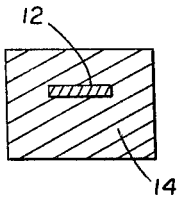
FIG. 2 is a cross-sectional view taken along line 2—2 of FIG. 1.

FIG. 2 is a cross-sectional view taken along line 2—2 of FIG. 1 and shows the inner layer or core 12 of copper encased in the outer layer 14 of powdered titanium.

Figure 3:
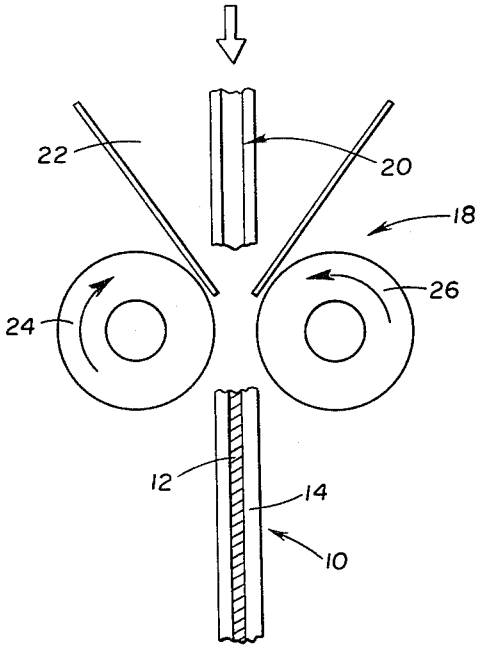
FIG. 3 is a diagrammatical illustration of a typical apparatus which can be utilized to produce articles of the type described and claimed herein.

FIG. 3 diagrammatically illustrates a typical powder rolling apparatus 18 which may be utilized to produce the composite structure of the subject invention. The apparatus illustrated in FIG. 3 includes a channel member 20 which is centrally positioned in a trough or feed mechanism 22. Channel 20 is used to direct material into the apparatus to form the inner layer or core of the composite structure. Trough 22 is used to direct materials into the apparatus which form the outer layer of the composite structure. Pressure rolls 24, 26 are used to compact the materials as they are fed therebetween. The resultant article is indicated at 10 and includes an inner layer of conductive material 12 having on the surface thereof an outer layer 14 of powdered titanium metal. As apparatus of the foregoing type are well known in the art, such apparatus will not be described herein in detail.

The apparatus described in FIG. 3 can be utilized to produce the composite structure of the invention by so-called tri-layer powder rolling techniques wherein both the outer layer or layers of titanium, as the case may be, and the inner layer of conductive material are in powder form. This apparatus also can be utilized to fabricate composite structures of the invention wherein a highly conductive screen, grid or foil is fed into the center of the roll nip with titanium powder being fed to both sides. In such a case, it is not necessary that channel 20 be present.

In addition to the above general techniques, another way of fabricating the articles of the invention is to position the conductive inner material between two sheets of preformed powdered titanium metal and then pressure bond them together. Still another means of fabricating the article of the invention is by first filling a die with titanium powder, covering the titanium powder with the conductor material, adding additional titanium powder to cover the conductor material, and then pressing the so-formed structure.

Regardless of the specific technique utilized to fabricate the article of the invention illustrated in FIGS. 1–4, it is necessary that (1) the first outer layer of titanium powder be pressed to a degree sufficient to reduce its porosity as desired and (2) that the resultant structure be sintered at a temperature sufficient to cause the outer layer of powdered titanium to become bonded to the inner layer of conductive material.

Figure 4:
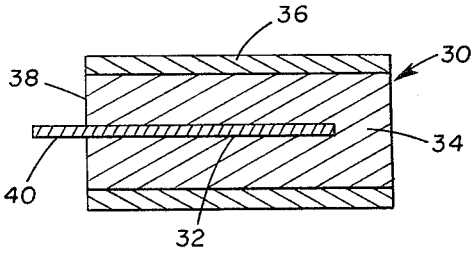
FIG. 4 is a diagrammatical illustration of another form of an electrode having a surface layer of porous titanium which was constructed in accordance with the subject invention.

FIG. 4 illustrates an electrode configuration which is similar to that shown in FIG. 1 but which has on the outermost surface thereof a layer of sintered porous titanium powder. Specifically, FIG. 4 depicts an electrode 30 which includes an inner conductive layer 32 having metallurgically bonded to the surface thereof a first outer layer 34 of sintered powdered titanium which, in turn, is encased in a second outer layer of sintered porous titanium powder 36. As illustrated, for the purpose of making suitable electrical contact, the conductive inner layer 32 extends beyond end 38 of electrode 30. The portion of the conductive inner layer 32 which extends beyond end 38 of electrode 30 is designated element 40. In the preferred embodiment of the invention, the first outer layer has a density of about 90 percent, to render it impermeable to brine, whereas the second outer layer 36 has an apparent density of from about 30 to about 90 percent, to render it suitable for carrying a coating of conductive mixed metal oxides. The second outer layer can be applied by various techniques which in themselves do not form a part of the subject invention. For example it can be applied by slip casting, powder rolling, spraying and the like. As all of these techniques are well known in the art, they will not be discussed herein in detail.

The subject invention will now be described with reference to the following examples.

EXAMPLE I

A thirteen inch by thirty-eight inch carbon mold was filled with through 200 mesh titanium powder to a depth of about 0.155 inches. This material was then pre-sintered at a temperature of about 1600° F. for two hours. The thickness of the presintered material was 0.148 inches. Subsequently, a plurality of six by six inch sections were cut from the before discussed pre-sintered stock. A sheet of forty mesh copper screen, four by five and one-half inches in size, was placed between two six by six sheets of pre-sintered titanium powder in such a fashion that about one inch of screen protruded from the soformed sandwich. This structure was then pressed at 65 tons per square inch in a Baldwin press with the resultant thickness being about 0.105 to 1.108 inches. This structure was then rolled on the standard mill to obtain a ninety percent dense article. The so-rolled article was then sintered at 1600° F. for two hours.

An examination of the resultant structure showed that the titanium had become metallurgically bonded to the copper screen. This article was then suitable for use as an electrode in an electrolytic cell.

EXAMPLE II

Using a horizontal rolling mill of the type shown in FIG. 3, through 60 mesh titanium powder is fed on either side of a channel member 20 by means of a hopper (not shown). Simultaneously lengths of a formed material (expanded cold rolled steel, 0.045 inches thick and 4½" wide by 24" long) are fed through channel member 20. Pressure rolls 24, 26 compact the titanium powder to a degree such that upon sintering the resultant article is impervious to brine. The expanded metal is fed through channel member 20 in such a fashion that it is essentially completely encapsulated or encased in the powdered metal. After the strip is rolled, it is then sintered at 1800° F. for a period of about 3 hours under vacuum conditions ($10^{-5}$ Torr). So produced structure can be utilized as an electrode for the production of chlorine and caustic.

EXAMPLE III

Using a horizontal rolling mill of the type shown in FIG. 3, through 60 mesh titanium powder is fed on either side of the center of the trough where a hopper (not shown) has been substituted for the channel member 20. Simultaneously powdered core material (through 60 mesh iron) is intermittently fed via the center hopper. These materials are then passed through pressure rolls 24, 26 and compacted. The resultant structure consists of a center layer of compacted powdered iron sandwiched between covering layers of compacted powdered titanium. This structure is then sintered at 1800° F. for about 2 hours under vacuum conditions ($10^{-5}$ Torr). The resultant sintered article finds utility as an electrode for use in the electrolytic production of chlorine and caustic.

EXAMPLE IV

Using a horizontal rolling mill of the type shown in FIG. 3, the following feeding arrangement is employed. Channel 20 is replaced by a central hopper through which 60 mesh iron powder is fed. This material forms the conductive inner core. On each side of the central hopper is another hopper for feeding through 60 mesh powdered titanium. This material forms the first outer layer. In turn, still another hopper is positioned on each side of the first outside hopper for simultaneously feeding a mixture of through 60 mesh titanium and through 40 mesh sodium chloride. This material is used to form the second outer layer. These powders are simultaneously fed through pressure rolls 24, 26. The resultant structure is a compacted powdered article having a core of compacted iron, a first outer layer of compacted powder titanium and a second outer layer which is a mixture of powdered titanium and a pore former, i.e. sodium chloride. The pressure applied by the rollers 24, 26 is adjusted in such a manner that upon subsequent sintering the first outer layer of powdered titanium is compacted to a degree sufficient to render it impermeable to brine. As above noted, the second outer layer consists of a mixture of powdered titanium and a pore forming material. The composition or make-up of this mixture is determined empirically adjusting the ratio of materials so that the porous surface of the resultant structure, when sintered, has an apparent density ranging from about 30 to about 90 percent. The so-compacted article is then subjected to a sintering treatment under vacuum conditions. A temperature of about 1800° F. is utilized. The duration of sintering is varied as desired. During this sintering technique the pore forming material, i.e., the sodium chloride, vaporizes to produce a structure having the desired degree of surface porosity. The resultant article readily accepts a surface coating of mixed metal oxides and therefore finds exceptional utility as an electrode in the electrolytic production of chlorine and caustic.

EXAMPLE V

A composite electrode was produced utilizing the technique described in Example IV above, except that a section of expanded cold rolled steel was used in lieu of the powdered core forming material. The section of expanded metal, having on its surface a first layer of powdered titanium and a second layer covering said first layer consisting of a mixture of powdered titanium and a pore forming material (sodium chloride), was passed through pressure rolls 24, 26 to compact the powder layers. The resultant structure was then sintered at a temperature of about 1800° F. At this temperature the sodium chloride vaporizes. The resultant structure consists of a core of the expanded metal having its surface a first outer layer of pressed and sintered titanium powder which is essentially impermeable to brine (has density of about 90%) and a second outer layer of sintered porous powdered titanium (having an apparent density of about 30 to 90 percent). The structure so produced is ideally suited for use as an electrode for the electrolytic production of chlorine.

A composite structure consisting of titanium and iron produced according to the subject invention has an electrical conductivity which is 2.0 to 2.7 times that of wrought chemically pure titanium. This will allow the production of 0.46 to 0.62 inch thick, tri-layer strips to yield the same conductivity as 0.125 inch thick wrought titanium. This significant reduction in the amount of material required to achieve the desired degree of conductivity would have obvious benefits in the electrochemical industry.

In the practice of the present invention, when the resultant structure is intended for use in a brine containing environment, it is essential that the powder layer of titanium be compacted to a degree sufficient to prevent brine (an aqueous solution of sodium chloride, potassium chloride or the like) from penetrating into the structure and contacting the inner layer of conductive metal. In the practice of the subject invention the inner layer or core can be fabricated from such materials as carbon, iron, copper, nickel, manganese and the like. All that is required is that (1) the material used to form the inner layer be more conductive than titanium and (2) it does not adversely react with the outer layer of titanium when the structure is sintered.

When the composite structure of the invention is intended for use as an electrode in an electrochemical cell which utilizes a brine electrolyte, it is important that the outer titanium layer be compacted to a degree sufficient to prevent brine from permeating it and coming into contact with the inner conductive layer. In practice, it is desired to compact this layer of titanium to a degree such that it has a density which is in excess of about 90 percent of theoretical density.

In the preferred practice of the invention, the desired composite structure is produced by powder rolling. This technique enables one, if desired, to completely encapsulate the inner conductive core in a first outer layer of powdered titanium thereby obviating edge and end sealing problems of the type which are normally experienced when one attempts to encapsulate an inner core material between covering layers of wrought titanium.

As before noted, the inner layer of conductive material can take many forms. For example it can be foil, expanded metal sheet, powder or the like.

The invention has been described herein with reference to various embodiments thereof. Obviously, modifications and alterations will occur to others upon the reading and understanding of the specification. It is my intention to include all such modifications and alterations insofar as they come within the scope of the appended claims or the equivalent thereof.

The invention claimed is:

1. An electrically conductive composite electrode comprising an inner layer of an electrically conductive material, a first outer layer of pressed and sintered powdered titanium metallurgically bonded thereto, and a second outer layer of sintered porous powdered titanium bonded to at least a portion of the surface of the first outer layer, said first outer layer of powdered titanium being compacted to a degree sufficient to render it essentially impermeable to aqueous brine and the surface of the second outer layer of titanium being porous and having an apparent density of from about 30 to 90 percent.

2. The composite structure of claim 1 wherein said inner layer of electrically conductive material is selected from the group consisting of carbon, iron, copper, nickel, manganese and mixtures thereof.

3. The composite structure of claim 2 wherein said metal is iron.

4. The composite structure of claim 2 wherein said metal is copper.

5. The composite structure of claim 2 wherein said first outer layer of titanium has an apparent density which is in excess of 90 percent of its theoretical density.

6. The composite electrode of claim 1 wherein said first layer of titanium has an apparent density which is in excess of 90 percent of its theoretical density.

* * * * *